US009867434B2

(12) United States Patent
Buffa

(10) Patent No.: US 9,867,434 B2
(45) Date of Patent: Jan. 16, 2018

(54) WATCH STRAP

(71) Applicant: Lorenzo Buffa, Philadelphia, PA (US)

(72) Inventor: Lorenzo Buffa, Philadelphia, PA (US)

( * ) Notice: Subject to any disclaimer, the term of this patent is extended or adjusted under 35 U.S.C. 154(b) by 0 days.

(21) Appl. No.: 15/130,742

(22) Filed: Apr. 15, 2016

(65) Prior Publication Data

US 2016/0324275 A1 Nov. 10, 2016

Related U.S. Application Data

(60) Provisional application No. 62/158,669, filed on May 8, 2015.

(51) Int. Cl.

| | |
|---|---|
| ***A44C 5/00*** | (2006.01) |
| ***A44C 5/14*** | (2006.01) |
| *B27D 1/00* | (2006.01) |

(52) U.S. Cl.

CPC ..... *A44C 5/0053* (2013.01); *A44C 5/14* (2013.01); *B27D 1/00* (2013.01); *Y10T 29/49591* (2015.01)

(58) Field of Classification Search

CPC ... A44C 5/00; A44C 5/0053; Y10T 29/49588; Y10T 29/4959; Y10T 29/49591; Y10T 29/4953; Y10T 24/4782

See application file for complete search history.

(56) References Cited

U.S. PATENT DOCUMENTS

| | | | | |
|---|---|---|---|---|
| 1,819,775 | A | 8/1931 | Elmendorf | |
| 1,840,047 | A * | 1/1932 | Mealy | A44C 5/025 29/896.411 |
| 1,902,032 | A | 3/1933 | Horine | |
| 2,070,527 | A | 2/1937 | Elmendorf | |
| 2,189,096 | A | 2/1940 | Alonge | |
| 2,388,479 | A | 11/1945 | Goldman | |
| 4,818,590 | A | 4/1989 | Prince et al. | |
| 5,605,262 | A | 2/1997 | Bond | |
| 6,649,245 | B2 | 11/2003 | Lenderink | |
| 7,021,041 | B2 | 4/2006 | Verdon et al. | |

(Continued)

FOREIGN PATENT DOCUMENTS

| | | |
|---|---|---|
| CN | 203226361 U | 10/2013 |
| CN | 204832783 U | 12/2015 |

(Continued)

OTHER PUBLICATIONS

Hu, Ray, "Wood for Your Wrist"' Sep. 7, 2012; 11 pages.

(Continued)

*Primary Examiner* — Justin Larson

(74) *Attorney, Agent, or Firm* — Blank Rome LLP

(57) ABSTRACT

A watch strap that includes a flexible strap body, which defines a longitudinal axis and has a portion configured to accommodate a watch body. The flexible strap body includes a wood veneer outer layer that has a natural wood grain, which is transverse to the longitudinal axis of the flexible strap body. A base layer of the strap body supports the wood veneer outer layer. The flexible strap body is bendable about the longitudinal axis against the natural wood grain of the wood veneer outer layer with substantially no cracking of the wood veneer outer layer. The flexible strap body is bendable about an axis transverse to the longitudinal axis in directions both towards and away from the wood veneer outer layer with substantially no cracking of the wood veneer outer layer.

20 Claims, 5 Drawing Sheets

(56) References Cited

U.S. PATENT DOCUMENTS

| | | | | |
|---|---|---|---|---|
| 2004/0253410 | A1* | 12/2004 | Higgins | B32B 5/26 428/96 |
| 2010/0122400 | A1 | 5/2010 | Nelson | |
| 2014/0377511 | A1* | 12/2014 | Katare | G02B 5/0808 428/192 |

FOREIGN PATENT DOCUMENTS

| | | | | |
|---|---|---|---|---|
| EP | 3327953 | A2 | 8/1989 | |
| EP | 0401169 | A2 | 12/1990 | |
| EP | EP 0401169 | A2 * | 12/1990 | A41D 25/00 |
| FR | 2721182 | A1 | 12/1995 | |
| FR | 2754681 | A1 | 4/1998 | |
| WO | 2010109039 | A1 | 9/2010 | |

OTHER PUBLICATIONS

MOCO LOCO Submissions, "Sewn Wood Accessories" Feb. 18, 2014; 13 pages.

Konohazuk, "The Wood Headphone H3"; The H3 are made from Japanese Beachwood and deliver high-quality sounds. Jul. 20, 2017; 7 pages.

Tripish, "Outie Headphones: Parametric Bent Wood Lamination"; 19 pages.

httpp://www.vicespy.com/valerii-danevychs-wooden-timepieces; Valerii Danevych's—Retrograde; Jul. 20, 2017; 3 pages.

Fox Home Center, Inc.; "Band-It Real Wood Veneer and Edging"; Jul. 20, 2017; 5 pages.

Atlanta Made Jewelry, Partner Profiles; "Veneer Bracelets by Forestique, Sleek and Eco-Friendly"; Jul. 3, 2013; 2 pages.

English translation; French Application No. FR2721182; 57 pages.

* cited by examiner

WATCH STRAP

RELATED APPLICATION

This application claims priority to U.S. Provisional Patent Application Ser. No. 62/158,669 entitled Flexible Watch Strap, and filed on May 8, 2015, the subject matter of which is herein incorporated by reference.

FIELD OF THE INVENTION

The present application relates to a watch strap that has a pleasing wood aesthetic and is soft and pliable allowing the watch strap to bend without substantially cracking the natural wood grain of the strap.

BACKGROUND OF THE INVENTION

Within the field of watch-straps, manufacturers and designers have produced straps of different materials, qualities, and compositions. Within the watch industry exists a niche market of watches made of wood. These watches are most typically paired with a strap comprised of separate individual wooden links. Some watch straps have been made from wood plates with a vertical or longitudinal wood grain; however because of the hardness of the wood, the thickness of the wood, and the direction of the wood grain, such watch straps crack, which is aesthetically unappealing. Additionally, the density and dryness of commercial wood plates typically makes them a poor material choice for watch straps.

Therefore, there is a need for a watch strap that provides and maintains a wood aesthetic without substantial cracking.

SUMMARY OF THE INVENTION

Accordingly, an exemplary embodiment of the present invention provides a watch strap that includes a flexible strap body, which defines a longitudinal axis and has a portion configured to accommodate a watch body. The flexible strap body may include a wood veneer outer layer that has a natural wood grain which is transverse to the longitudinal axis of the flexible strap body. A base layer of the strap body supports the wood veneer outer layer. The flexible strap body is bendable about the longitudinal axis against the natural wood grain of the wood veneer outer layer with substantially no cracking of the wood veneer outer layer. The flexible strap body is also bendable about an axis transverse to the longitudinal axis in directions both towards and away from the wood veneer outer layer with substantially no cracking of the wood veneer outer layer. In one embodiment, a support layer may be provided between the wood veneer outer layer and the base layer.

The present invention may also provide a watch strap that has a flexible strap body which defines a longitudinal axis and has a portion configured to accommodate a watch body. The flexible strap body may include a wood veneer outer layer that has natural wood grain that is transverse to the longitudinal axis of the flexible strap body. A support layer supports the wood veneer outer layer and a base layer supports the support layer. An edge sealant is disposed along first and second opposing longitudinal side edges of the flexible strap body for sealing the wood veneer outer layer, the support layer, and the base layer together.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Referring to FIGS. 1-4A, 4B, and 4C, the present invention relates to a watch strap 10 that is sufficiently soft and pliable to avoid substantial cracking of the natural grain of the wood to maintain an acceptable wood aesthetic no matter which direction the watch strap 10 is bent. The watch strap 10 may be associated with a watch or any other item to be worn on the wrist. The term "strap" in the present invention includes all devices for holding a wrist watch in position on the wrist. Due to the flexible and pliable nature of the watch strap 10, a user may wear the watch strap around the user's wrist with an appealing wood aesthetic without the displeasing look of cracked wood. The watch strap 10 of the present invention is preferably made of genuine wood and may be sealed along its edges and surfaces, thereby providing resistance to edge and surface fracturing. By utilizing the natural grain structure of the wood in combination with an added sealant, the watch strap 10 of the present invention visually heals itself at its bend points, such as near the buckle where the strap must slide under the buckle to be fastened.

Figure 1:
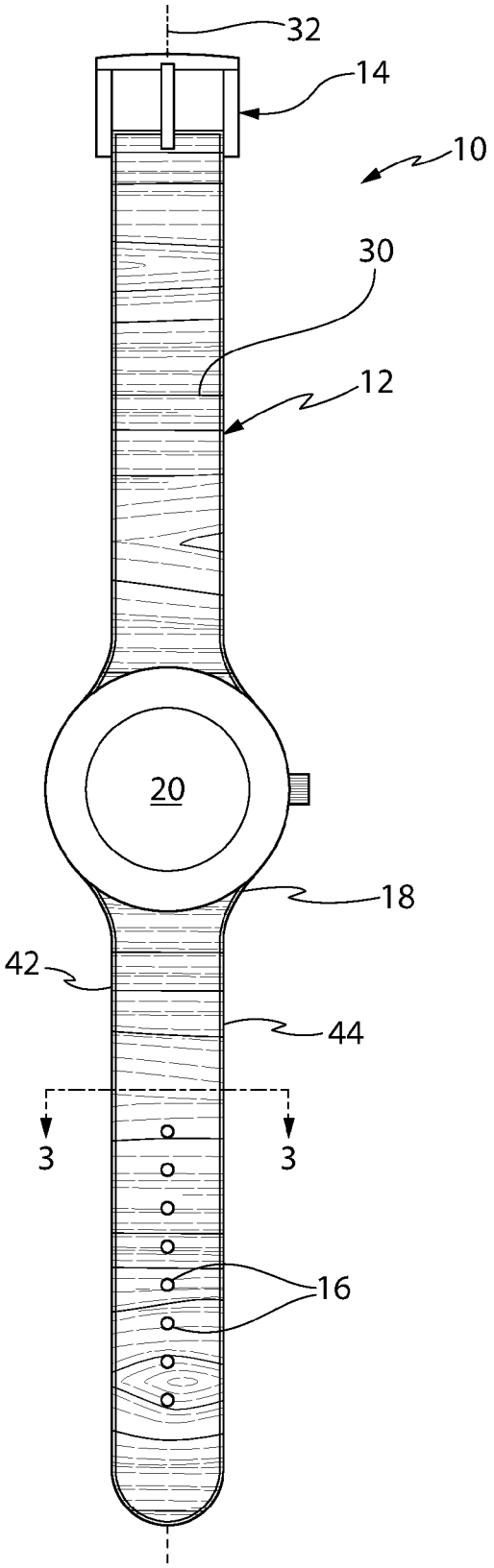
FIG. 1 is top plan view of a watch strap in accordance with an exemplary embodiment of the present invention.
Figure 2:
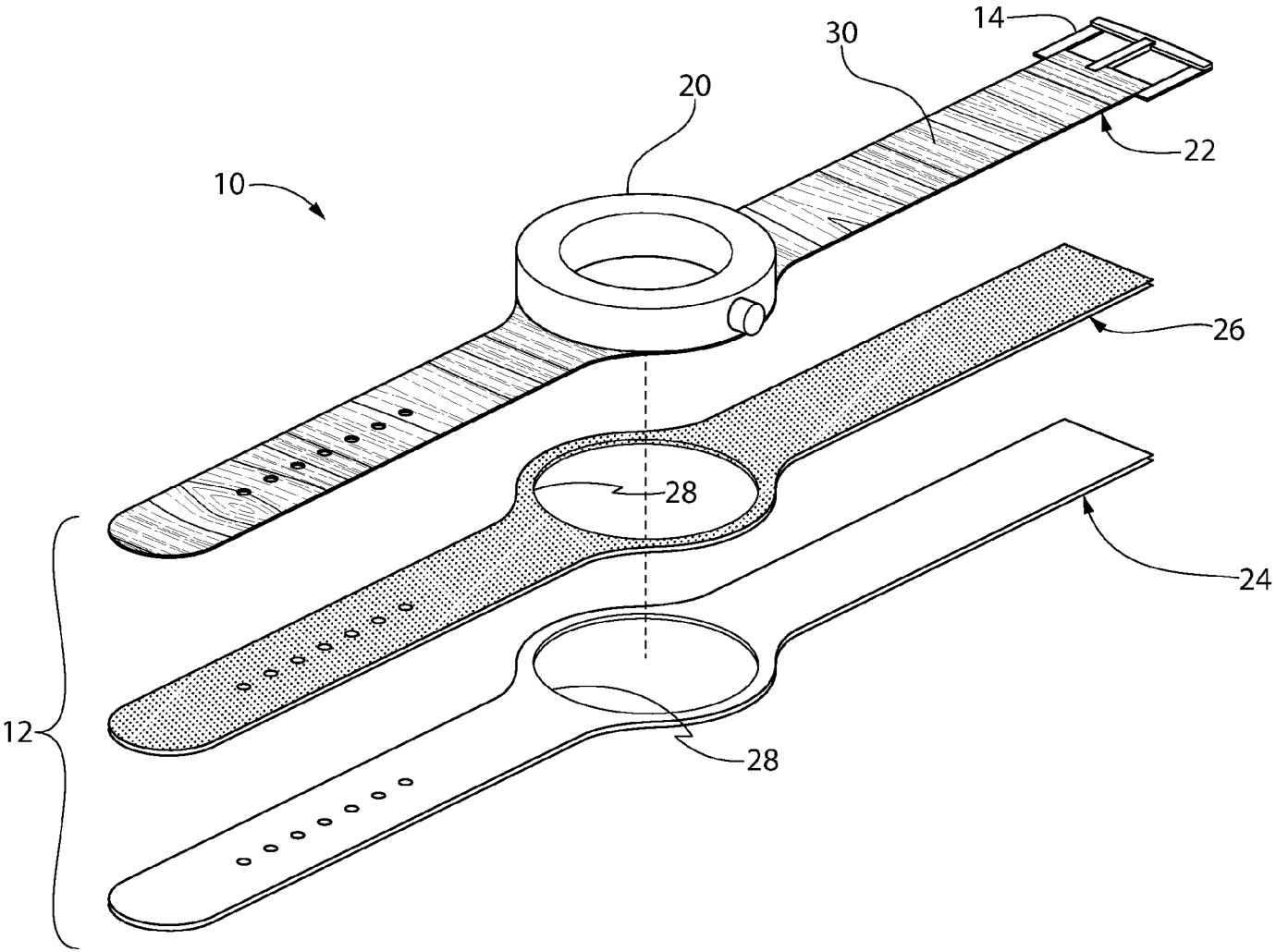
FIG. 2 is an exploded view of the watch strap illustrated in FIG. 1.

The watch strap 10 of the present invention includes a flexible strap body 12 that may have a buckle 14 at one end, corresponding adjustment holes 16 near the other end for engaging the buckle 14, and a portion 18 therebetween for accommodating the watch body 20, as best seen in FIG. 1. Other known mechanisms for fastening the watch strap 10 may be used as an alternative to the buckle 14. In a preferred embodiment, the flexible strap body 12 may be formed of multiple layers, including a wood veneer outer layer 22, a base layer 24, and a support layer 26 therebetween, as seen in FIG. 2. The term "wood veneer" means a very thin slice of wood. Each layer 22, 24, and 26 is preferably shaped in the form of a strap suitable for wearing around a user's wrist. An opening 28 may be provided in each layer 22, 24, and 26 for accommodating the watch body 20.

Figure 4A:
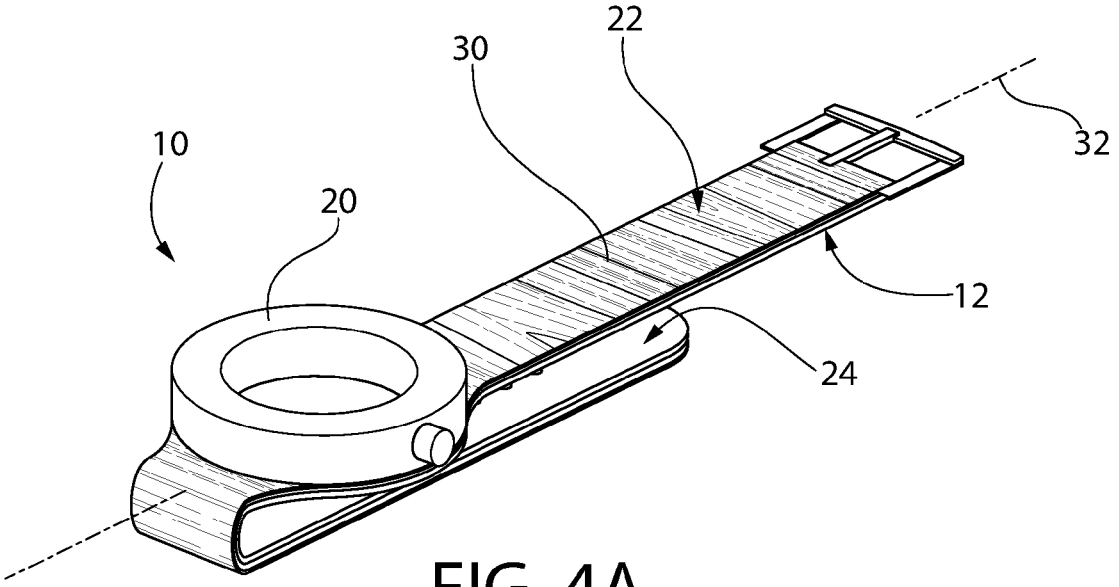
FIGS. 4A thru 4C are perspective views of the watch strap illustrated in FIG. 1, showing the bendability of the watch strap in all directions without substantial cracking of the natural wood grain.
Figure 4B:
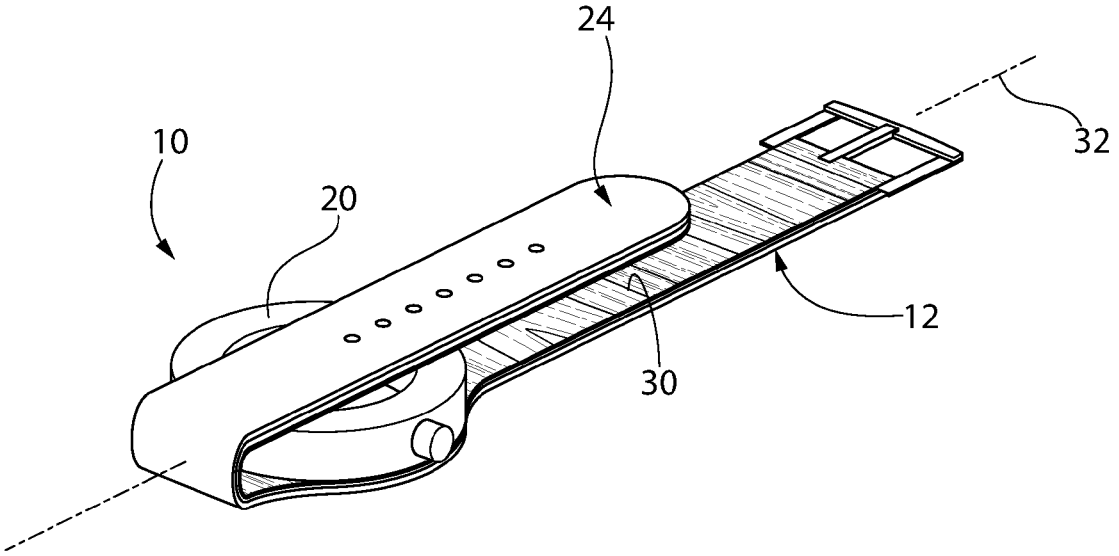

The wood veneer outer layer 22 is very thin layer formed of genuine wood, such as makore, silverheart, teak, and the like. The direction of the wood grain 30 of the wood veneer outer layer 22 is preferably horizontal, that is transverse to the longitudinal axis 32 of the strap body 12, and is therefore self-healing when bent. In a preferred embodiment, the thickness of the wood veneer outer layer 22 is less than 25% of the thickness of the base layer 24. For example, the wood veneer outer layer 22 may be 0.22 mm thick where the base layer 24 is 1 mm thick. The wood veneer may be treated to provide more softness and folding endurance. The term 'treated" refers to, but is not limited to, the additional process of covering or sealing the wood veneer outer layer 22 with a polymer, acrylic, a resin compound, or the like. The direction of the wood grain 30 being transverse to the strap's longitudinal axis 32 combined with the thin and thus flexible nature of the wood veneer outer layer 22, allows the strap to bent in any direction with little or no cracking of the wood (as seen in FIGS. 4A-4B), thereby by maintaining an acceptable wood aesthetic to the user.

The base layer 24 may be formed of fabric, leather, plastic, rubber, textiles, and the like. The support layer 26 is configured to help with the horizontal grain self-healing properties of the wood veneer outer layer 22 and also thickens the strap 10 to maintain the appropriate radius and size around the user's wrist. The support layer 26 may be 0.75 mm, for example. The support layer 26 may be formed of foam, for example. Although the strap body 12 preferably includes the support layer 26, the strap body 12 of the present invention may be formed without the support layer 26, such that the wood veneer outer layer 22 is disposed directly on the base layer 24.

Figure 3:
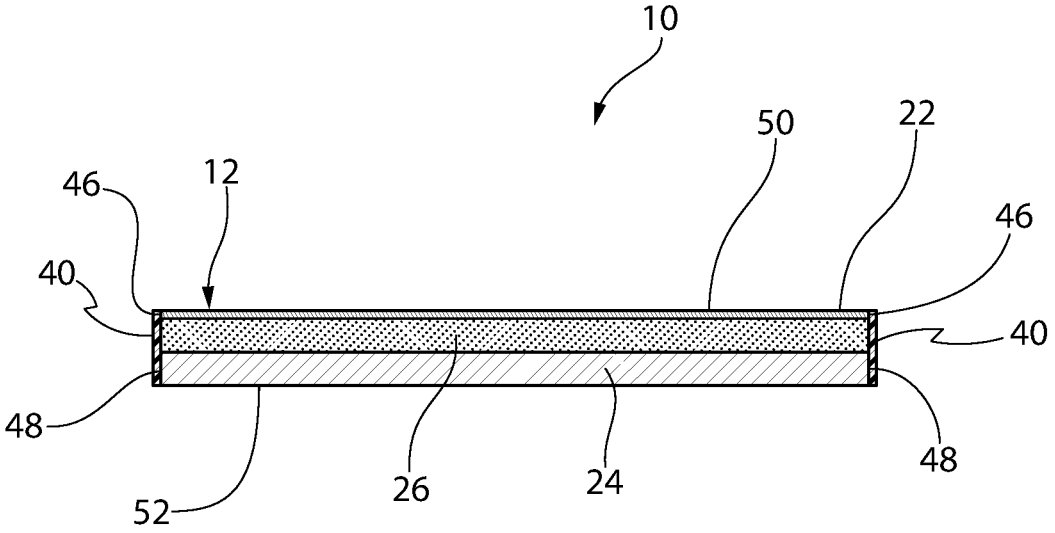
FIG. 3 is a cross-sectional view of the watch strap illustrated in FIG. 1 taken along line 3-3 of FIG. 1.

As best seen in FIG. 3, the watch strap 10 of the present invention preferably includes a protective edge sealant 40 applied to each of the longitudinal side edges 42 and 44 (FIG. 1) of the strap body 12 for sealing the layers 22, 24 and 26 thereof together. The edge sealant 40 is adapted to prevent the wood material from fracturing and chipping. The edge sealant 40 may be an adhesive or an acrylate polymer based edge coating, or the like. The applied protective edge sealant 40 extends at least between the outer edge surface 46 of the wood veneer outer layer 22 to the outer edge surface 48 of the base layer 24. The edge sealant may overlap slightly on the outer surface 50 and 52 of the wood veneer outer layer 22 and the base layer 24, respectively.

The strap body 12 may be formed by first adhering the wood veneer outer layer 22 either directly to the base layer 24 or to the support layer 26 which can then be adhered to the base layer 24, in any size flat sheet which is then die-cut into the watch strap shape, and lastly sealed around the edges using the protective edge sealant 40. Alternatively, the strap body 12 may be formed by first die-cutting, laser-cutting, or stamping the wood veneer outer layer 22, the base layer 24, and the optional support layer 26 into the watch strap shape, adhering those layers together, and then finally applying the edge sealant 40 to the longitudinal strap edges 42 and 44. The edge sealant 40 may be applied mechanically, by hand, or with the use of a rolling applicator.

Figure 4C:
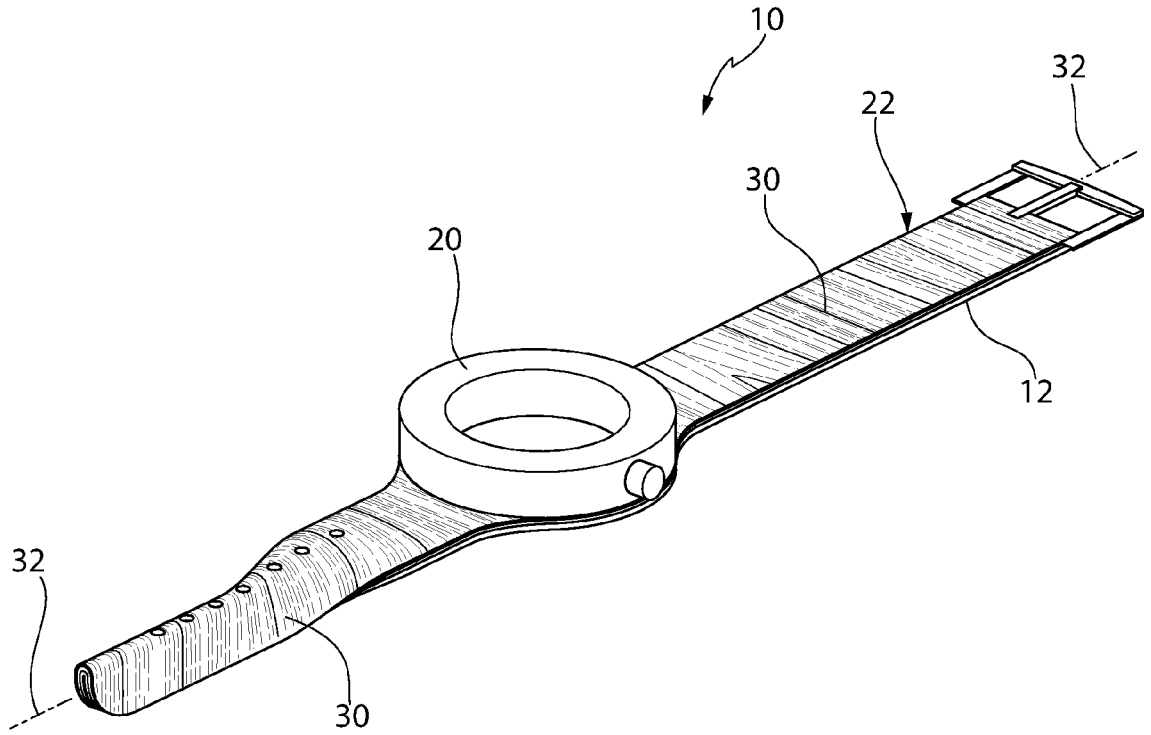

Referring to FIGS. 4A-4B, the direction of the grain 30 of the wood veneer outer layer 22 combined with its flexible and pliable nature, allows the watch strap 10 to bend in all directions with little or no cracking, thus maintaining an acceptable wood aesthetic to the user. As seen in FIGS. 4A and 4B, the strap body 12 is bendable about an axis transverse to the longitudinal axis 32 in directions both away from (FIG. 4A) and towards (FIG. 4B) the wood veneer outer layer 22 with substantially no cracking of that layer 22. As seen in FIG. 4C, the strap body 12 is bendable about the longitudinal axis 32 against the wood grain 30 of the wood veneer outer layer 22 again with substantially no cracking of that layer 22.

While particular embodiments have been chosen to illustrate the invention, it will be understood by those skilled in the art that various changes and modifications can be made therein without departing from the scope of the invention as defined in the appended claims. For example, the strap body 12 may be formed as two pieces that are attached to the watch body. That is, the two pieces function to form a portion of the strap body that is configured to accommodate the watch body 20, such by using conventional watch lugs.

What is claimed is:

1. A watch strap, comprising a flexible strap body, said flexible strap body defining a longitudinal axis and having a portion configured to accommodate a watch body, said flexible strap body including, a wood veneer outer layer, said wood veneer outer layer having a natural wood grain, said natural wood grain being transverse to said longitudinal axis of said flexible strap body, and a base layer supporting said wood veneer outer layer, wherein said flexible strap body is bendable about said longitudinal axis against said natural wood grain of said wood veneer outer layer, and wherein said flexible strap body is bendable about an axis transverse to said longitudinal axis in directions both towards and away from said wood veneer outer layer.

2. A watch strap according to claim 1, wherein a thickness of said wood veneer outer layer is less than 25% of a thickness of said base layer.

3. A watch strap according to claim 2, wherein the thickness of said wood veneer outer layer is about 0.22 mm and the thickness of said base layer is about 1 mm.

4. A watch strap according to claim 1, wherein said flexible strap body includes a support layer between said wood veneer outer layer and said base layer.

5. A watch strap according to claim 4, wherein said wood veneer outer layer is formed of makore, silverheart, or teak.

6. A watch strap according to claim 5, wherein said base layer if formed of leather, fabric, plastic, or rubber.

7. A watch strap according to claim 6, wherein said support layer is formed of foam.

8. A watch strap according to claim 7, wherein an edge sealant is disposed along first and second opposing longitudinal side edges of said flexible strap body for sealing said wood veneer outer layer, said support layer, and said base layer together.

9. A watch strap according to claim 8, wherein each of said edge sealants extends from at least an outer edge surface of said wood veneer outer layer to an outer edge surface of said base layer.

10. A watch strap according to claim 9, wherein each of said edge sealants is an adhesive or acrylate polymer coating.

11. A watch strap, comprising a flexible strap body, said flexible strap body defining a longitudinal axis and having a portion configured to accommodate a watch body, said flexible strap body including, a wood veneer outer layer, said wood veneer outer layer having a natural wood grain, said natural wood grain being transverse to said longitudinal axis of said flexible strap body, a support layer supporting said wood veneer outer layer, a base layer supporting said support layer, and an edge sealant disposed along first and second opposing longitudinal side edges of said flexible strap body for sealing said wood veneer outer layer, said support layer, and said base layer together.

12. A watch strap according to claim 11, wherein each of said edge sealants extends at least from an outer edge surface of said wood veneer outer layer to an outer edge surface of said base layer.

13. A watch strap according to claim 12, wherein each of said edge sealants is an adhesive or acrylate polymer coating.

14. A watch strap according to claim 11, wherein said flexible strap body is bendable about said longitudinal axis against said natural wood grain of said wood veneer outer layer, and said flexible strap body is bendable about an axis transverse to said longitudinal axis in directions both towards and away from said wood veneer outer layer.

15. A watch strap according to claim 11, wherein said wood veneer outer layer is formed of makore, silverheart, or teak.

16. A watch strap according to claim 15, wherein said base layer if formed of leather, fabric, plastic, or rubber.

17. A watch strap according to claim 16, wherein said support layer is formed of foam.

18. A watch strap according to claim 11, wherein a thickness of said wood veneer outer layer is less than 25% of a thickness of said base layer.

19. A watch strap according to claim 11, wherein a thickness of said wood veneer outer layer is about 0.22 mm, a thickness of said base layer is about 1 mm, and a thickness of said support layer is about 0.75 mm.

20. A watch strap according to claim 11, wherein said flexible strap body includes a buckle at one end and a plurality of adjustment holes near an opposite end thereof for engaging said buckle.

* * * * *